United States Patent [19]

Turner

[11] Patent Number: 5,012,832

[45] Date of Patent: May 7, 1991

[54] WIND BLOCKING SCREEN

[76] Inventor: J. Clark Turner, 1660-A Chalcedony, San Diego, Calif. 92109

[21] Appl. No.: 373,797

[22] Filed: Jun. 29, 1989

[51] Int. Cl.[5] ..... E04H 15/00

[52] U.S. Cl. ..... 135/87; 135/117

[58] Field of Search ..... 135/101, 109, 112, 117, 135/900, 901, 902, 87; 229/52 R, 52 B, DIG. 6; 52/71, 102; 47/26; 256/25, 26

[56] References Cited

U.S. PATENT DOCUMENTS

| | | | |
|---|---|---|---|
| 1,843,108 | 2/1932 | Clayden | 256/25 |
| 2,465,147 | 3/1949 | Butler et al. | 160/127 |
| 2,576,384 | 11/1951 | Bentley | 160/181 |
| 2,781,767 | 2/1957 | Blankenship, Jr. | 135/109 |
| 2,784,779 | 3/1957 | Knipfer et al. | 135/109 |
| 2,997,277 | 8/1961 | Schwartz | 47/26 |
| 3,173,436 | 3/1965 | Peters | 135/5 |
| 3,434,483 | 3/1969 | Topham | 135/5 |
| 3,498,587 | 3/1970 | Friedberg | 135/109 |
| 3,581,751 | 6/1971 | Evans | 135/5 R |
| 3,709,237 | 1/1973 | Smith | 135/901 |
| 3,759,277 | 9/1973 | Glade | 135/109 |
| 3,913,598 | 10/1975 | Glutting, Jr. et al. | 135/4 R |
| 4,646,770 | 3/1987 | Lobato | 135/102 |
| 4,685,484 | 8/1987 | Moneta | 135/117 |
| 4,712,673 | 12/1987 | Moore | 229/52 B |
| 4,817,861 | 4/1989 | Henrikson | 229/52 B |
| 4,823,822 | 4/1989 | Maya | 135/87 |

FOREIGN PATENT DOCUMENTS

| | | | |
|---|---|---|---|
| 1958986 | 5/1971 | Fed. Rep. of Germany | 135/902 |
| 1434817 | 2/1966 | France | 47/26 |

OTHER PUBLICATIONS

Brochure Entitled "Quikabana", date unknown, three pages.

Brochure Entitled "Winbreaker", 1988, two pages.

*Primary Examiner*—John E. Murtagh

*Attorney, Agent, or Firm*—Brown, Martin, Haller & McClain

[57] ABSTRACT

A wind blocking screen comprises three flat panels of substantially rigid material joined together along integral fold lines to form a continuous row of panels which can be folded together into a flat configuration for storage and opened out at any desired angle to one another in an open, shielding configuration. Each panel has a handle opening adjacent the center of one of its edges which is positioned for alignment with corresponding openings in the other panels when they are folded flat, forming a hand grip for carrying the screen.

10 Claims, 1 Drawing Sheet

WIND BLOCKING SCREEN

BACKGROUND OF THE INVENTION

The present invention relates generally to screens of the type used for blocking the wind or the sun, or for privacy in open areas such as parks, beaches and the like.

Various types of wind blocking shields or screens are known, but these are generally of a relatively complex, unwieldy nature, involving stakes or anchors for anchoring the screen in the ground and canvas or like material extending between the stakes. These screens may be relatively heavy and unwieldy, and difficult to carry to and from a desired destination, such as a beach, for example, and relatively inconvenient to set up once there. Also, as time passes there is often a need to reposition the screen, which again causes inconvenience with a relatively complicated assembly that is difficult to position. Another problem is that such screens can only be used on relatively soft surfaces such as sand into which the stakes can be driven to anchor the screen.

SUMMARY OF THE INVENTION

It is an object of this invention to provide an improved, easier to use wind blocking screen.

According to the present invention, a wind blocking screen is provided which comprises at least three flat panels of substantially rigid material joined together along integral fold lines to form a continuous row of panels which can be folded together into a substantially flat, storage position and opened out at any desired angle to one another in an open, shielding or blocking position for use. Each of the panels has a handle opening adjacent the center of one of its edges which is positioned for alignment with corresponding openings in the other panels when they are folded flat for storage. This makes the screen easy to carry. Preferably, one of the openings has an integral flap or cut-out secured to it along one edge for passing through all three openings to secure the panels together when folded flat. This reduces the likelihood of the panels separating or opening out during transportation.

Preferably, the lower edges of the panels are serrated so that they can be pushed into the ground more easily to anchor the screen in place, which may be necessary under high wind conditions, for example. The panels are preferably of relatively lightweight cardboard material, making an inexpensive, lightweight and easy to carry wind blocking screen which will be much more convenient to carry to the beach or park. The panels may be provided with an integral fold out flap for forming a shelf or table to hold drinks, sunscreen, and the like. The panels are preferably of sufficient rigidity that they can be used alternatively as a table or sun blocking screen by placing the outermost panels at right angles to the center panel and pushing their free side edges into the ground so that the center panel forms a horizontal table or shade. This allows infants, for example, to be completely shielded from the sun and also provides a lightweight and easy to carry table for picnics and the like.

BRIEF DESCRIPTION OF THE DRAWINGS

The present invention will be better understood from the following detailed description of a preferred embodiment, taken in conjunction with the accompanying drawings, in which like reference numerals refer to like parts, and in which.

DESCRIPTION OF THE PREFERRED EMBODIMENT

FIGS. 1 to 5 illustrate a portable wind blocking screen 10 according to a preferred embodiment of the present invention. The screen basically comprises three panels 12,14,16 of lightweight but rigid cardboard material joined together along integral fold lines 18,20 to form a continuous row of side-by-side panels. The panels are formed from a single sheet of cardboard with creases or folds formed between adjacent panel sections, allowing the panels to hinge or pivot relative to one another into any desired configuration. Although cardboard is the preferred material for the screen, it may be made from alternative materials such as corrugated or plain plastic.

Figure 1:
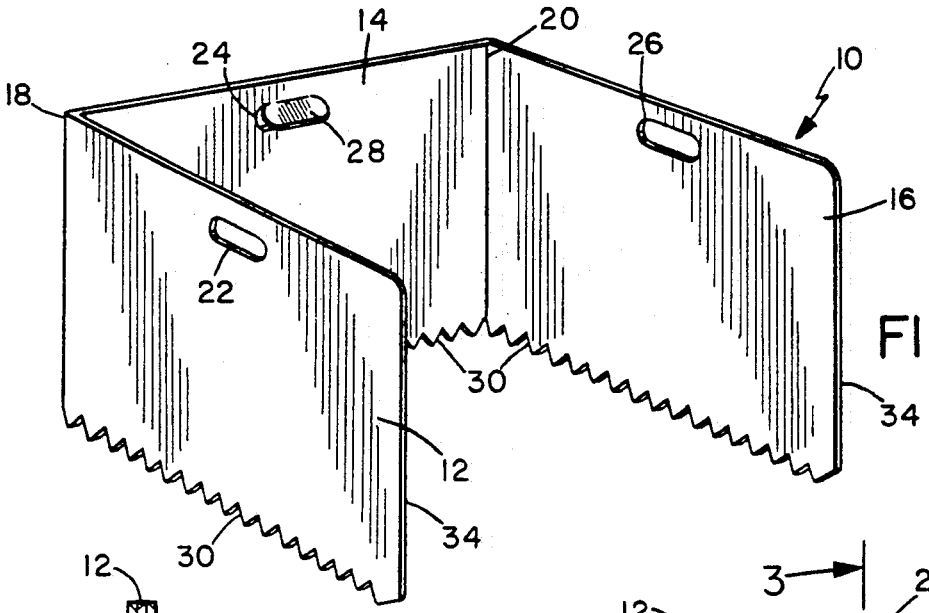
FIG. 1 is a perspective view of a wind blocking screen according to a preferred embodiment of the present invention in an erected, open position.
Figure 3:
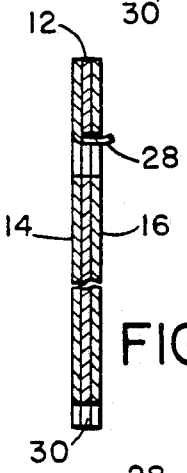
FIG. 3 is an enlarged sectional view taken on line 3—3 of FIG. 2.
Figure 2:
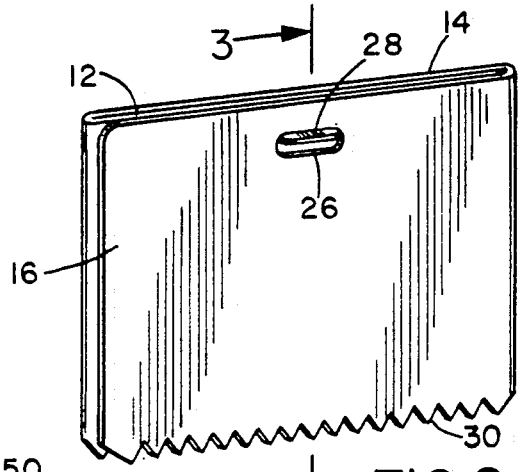
FIG. 2 illustrates the screen folded flat and closed for storage or carrying.

FIG. 1 illustrates the panels opened out into an erect form resembling a U on its side while FIG. 2 illustrates the panels folded flat against one another for storage or carrying. Each of the panels has an elongate slot or handle opening 22,24,26 of appropriate dimensions adjacent the center of its upper edge. The openings are positioned so that when the panels are folded flat as in FIG. 2, the openings are all aligned to form a continuous handle opening. The handle openings are formed by cutting out an appropriately shaped piece of cardboard from each of the panels. Preferably, the resultant cut out or flap 28 on one of the panels, for example the central panel 14 as illustrated in FIGS. 1 and 2, is left attached to the opening 24 in that panel along one edge. Flap 28 can be pulled through the openings 22,26 in the other two panels when they are folded flat, as illustrated in FIGS. 2 and 3, securing the panels together in their folded configuration and also making the panels easier to carry.

As illustrated in FIGS. 1 and 2, the lower edges 30 of the panels are preferably serrated or provided with saw teeth to allow the screen to be anchored in the ground more easily. The three joined panels can be opened out into any desired configuration for use as a wind blocking screen, with the lower edges 30 then pushed into the ground to anchor the screen in place. FIG. 1 illustrates one possible erect form of the screen in which it resembles a U-shape on its side. In addition to providing a block against wind, blowing sand or dirt, the screen also blocks vision from three sides in this configuration, providing a degree of privacy. The screen may also be used in an L-shaped configuration with two panels extending in a line and the third panel at right angles to the first two. This provides a wider wind block and screen. Alternatively, the screen may be fully extended with all three panels in a straight line, providing an even wider wind block and privacy screen.

One side of the board or screen 10 may be coated with a reflective material such as foil or the like to reflect the suns rays onto the sides of a sunbather using the screen, providing more even tanning while still blocking the user from wind, blown sand and the like. The opposite side may be printed with any desired information or decorative patterns, if desired, for example advertising and the like. The material may be directly printed on the board, or a printed poster may be laminated or adhered to the outer face of the cardboard to provide a better quality print. In this way, the panel can function as a portable, self-supporting billboard. Both sides of the screen may be provided with printed information or the like, if desired.

The serrated lower edges allow the screen to be dug into or anchored into ground such as sand, soil, grass, and so on, to provide added stability and wind resistance. However, in alternative embodiments the lower edges may be straight. It would still be possible to push the straight edges into sand or the like if necessary. The screen will be self supporting in light to modest breezes, and can therefore be used on hard surfaces such as concrete in such conditions without additional support being necessary.

Figure 4:
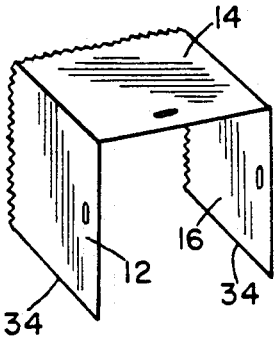
FIG. 4 is a perspective view illustrating an alternative erect position of the screen for use as a table or sun shield.

FIG. 4 illustrates an optional use of the screen in an inverted U-form to provide a table or sun shade. In this case, the two outer panels are directed downwards and are either pushed into the ground or rest on the ground at their lowermost edges 34 to form legs supporting the center panel horizontally. The center panel can then be used as a table to support various objects, and the screen can be used as a sun shade if needed to provide shade for a cooler, camera or film, or for a young child. This position also allows coverage of the head to prevent excessive burning and provides a shade area for reading in comfort.

Not only is the screen easy to carry when folded flat as illustrated in FIG. 2, but it also provides a rigid surface in this configuration which may serve as a portable desk for writing or drawing. The screen is relatively lightweight and takes up little space when carried or stored. The user will normally have a variety of other objects to carry, such as books, sunscreen, towels and the like, but will be able to manage the screen in addition to such items relatively easily because of its lightweight and its built in handles.

Figure 5:
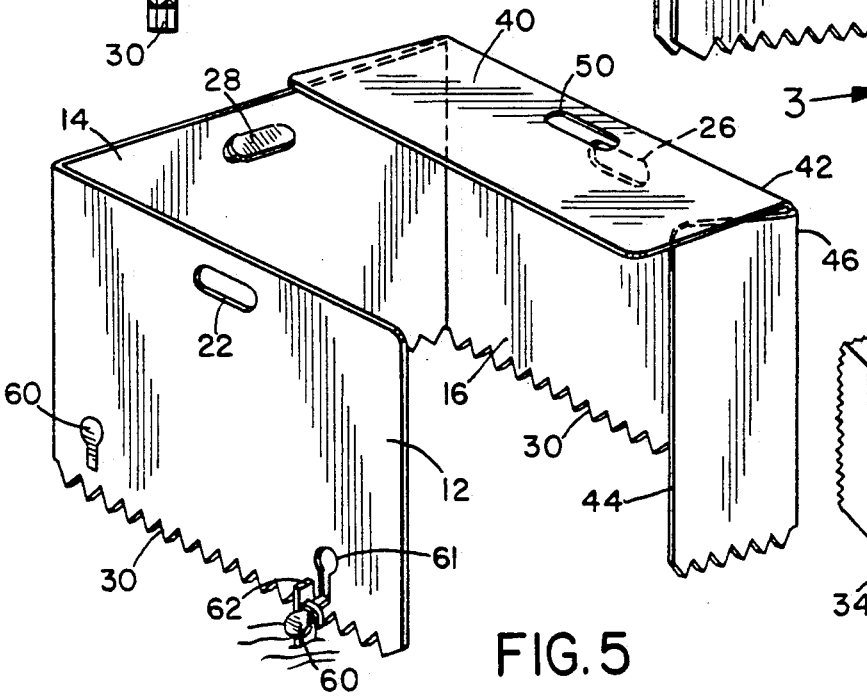
FIG. 5 is a perspective view of a modified screen with a platform or shelf surface.

FIG. 5 illustrates some optional modifications to the screen. Apart from the modifications described below, the screen in FIG. 5 is the same as illustrated in FIGS. 1 to 4, and like reference numerals have been used where appropriate. In this modification, one of the outer panels is provided with a fold-down flap 40 extending from its upper edge and connected to the outer panel via fold line or crease 42. The same panel also has an additional fold-out or support flap 44 extending along its outermost side edge and connected to the side edge via fold line or crease 46. The flaps 40 and 44 are formed integrally with the remainder of the screen with the entire device cut out of a single sheet of cardboard and subsequently folded or creased to form the various panels and flaps. If desired, flap 40 is folded up into the position illustrated in FIG. 5 to provide a support surface or shelf to hold various items such as sunscreen, drinks, and so on, while flap 44 is folded out into a supporting position under flap 40 to support it in the horizontal position illustrated, with the flap 40 resting on the upper edge of flap 44. Flap 44 may be anchored or pushed into the ground at its lower edge for added support. Flap 40 is about one third of the width of center panel 14 to provide a relatively large supporting area, and also to provide some shade if desired. When flap 40 is not in use, or when the panels are to be folded flat, flap 44 is simply folded in flat against panel 16, and flap 40 is then folded down flat against panels 16 and 44. As can be seen in FIG. 5, flap 40 is also provided with a handle opening 50 close to the center of crease 42 and positioned to coincide with handle opening 26 in panel 16 when the panels are all fully folded into a flat configuration.

Alternatively, or in addition to flap 40, one or more notches may be provided in the upper edge of the panel for hanging a camera, for example, so that it does not come into contact with the sand.

Also illustrated in FIG. 5 are a pair of optional keyhole shaped cut out flaps 60 which are die cut at spaced intervals adjacent the lower edge of the panels. The flaps 60 are shown in one of the panels only in FIG. 5, but it will be understood that similar flaps will be provided at equivalent locations on flaps 14 and 16. The flaps 60 fold down as illustrated, leaving keyhole shaped openings 61 for ventilation or observation. The flaps 60 themselves may be anchored by standard tent stakes 62 on windy days, the tent stakes being driven into the ground so that they hook over the thinner portion of flaps 60 as illustrated in FIG. 5, anchoring the screen in position. This will be particularly useful where the screen is used on grass, for example, where it may not be possible to anchor the lower edge of the screen in the ground.

The panels may be of any desired dimensions sufficient to provide a wind blocking screen for one or more adults. In one specific example, the panels were each of about 2 feet in width and and about $1\frac{1}{2}$ feet tall. The handle holes are suitably positioned about $1\frac{3}{4}$ inches from the adjacent edge of the panel. This allows the average adult to grip the handle relatively comfortably when the panels are folded flat. Although the handle openings are illustrated in the drawings as adjacent the upper edges of the panels, they may alternatively be positioned adjacent the lower edges 30. Preferably, the corners of the panels are slightly rounded to avoid snagging on clothing.

The wind blocking screen described above is an easy to use, one piece construction which requires no special or complicated assembly and has no separate parts to carry which could be lost. It is inexpensive, and provides a convenient surface for printing advertising material or the like, providing a portable, self-supporting bill-board. It folds completely flat for carrying and storage, and has built in handles so that it can be carried easily even when the carrier is encumbered with other beach or recreational items such as towels, coolers, and the like. It is of non-porous, continuous sheet material which blocks the wind more or less completely. If the lower edge is pushed into the sand or soil, wind seepage from the base will be prevented and the screen will be stable even in relatively high winds. The screen is opaque so that it also blocks vision to provide a degree of privacy. It can be moved quickly and easily from one position to another to accommodate wind shifts or movement of the sun, and may be used in various optional erect configurations to provide a one-sided, two sided or three sided wind block, or to provide a sun shade in an inverted U-configuration.

The screen will not harm the surface it is used on, and is self supporting. It can be used on hard surfaces in light to modest breezes, such as the concrete surrounds of swimming pools, for example. It can be used on any ground surface, not just sand, and provides privacy for sunbathing even in crowded areas such as close to streets or in parks or other recreational areas.

Although a preferred embodiment of the invention has been described above by way of example only, it will be understood by those skilled in the field that modifications may be made to the disclosed embodiment without departing from the scope of the invention, which is defined by the appended claims.

I claim:

1. A wind blocking screen comprising:

at least three panels of substantially rigid material joined together along integral fold lines to form a continuous row of side-by-side panels, the fold lines comprising means for allowing the panels to be folded flat against one another into a storage position or opened out at any desired angle to one another into an erect, wind blocking position;

the panels having spaced upper and lower edges, each of the lower edges having sharp pointed serrations along their length for cutting into earth or sand to anchor the screen in the ground, each panel having a handle opening adjacent the center of one of the edges positioned for alignment with the handle openings in the other two panels when the panels are folded into said storage position; and an integral cut-out flap at the edge of the handle opening in one of the panels for pulling through the other two openings to secure the panels together when they are folded flat.

2. The screen as claimed in claim 1, wherein the flap is provided on the central panel.

3. The screen as claimed in claim 1, wherein the panels are of cardboard material.

4. The screen as claimed in claim 1, wherein at least one of the outermost panels includes a fold-out flap at its upper edge movable between a storage position in which it is folded down flat against the respective panel and a fold out position in which it is folded out perpendicular to the panel to form a shelf, the panel further including support means for supporting said fold-out flap in said folded out position.

5. The screen as claimed in claim 4, wherein said support means comprises an additional flap at the outer side edge of said one outermost panel for folding out into a support position in which said fold-out flap rests on top of said additional flap.

6. The screen as claimed in claim 1, wherein one face of panels is coated with a reflective material.

7. The screen as claimed in claim 1, wherein said openings are located about $1\frac{3}{4}$ from said panel edges.

8. The screen as claimed in claim 1, wherein the panels are all formed from a single sheet of cardboard material cut to a predetermined size and formed with fold lines to separate adjacent panels, and the handle openings are cut out from the cardboard material.

9. A wind blocking screen comprising:

three panels only of substantially rigid material joined together along integral fold lines to form a continuous row of side-by-side panels, the fold lines comprising means for allowing the panels to be folded flat against one another into a storage position or opened out at any desired angle to one another into an erect, wind blocking position;

the panels having spaced upper and lower free edges, each of the lower edges having thin, downwardly facing sharp edges comprising means for cutting into earth or sand to anchor the screen in the ground, each panel having a handle opening adjacent the center of one of the edges positioned for alignment with the handle openings in the other two panels when the panels are folded into said storage position; and one of the panels having an integral cut-out flap at the edge of the handle opening in that panel for pulling through the other two openings to secure the panels together when they are folded flat.

10. A wind blocking screen, comprising:

at least three panels of substantially rigid material joined together along integral fold lines to form a continuous row of side-by-side panels, the fold lines comprising means for allowing the panels to be folded flat against one another into a storage position or opened out at any desired angle to one another into an erect, wind blocking position;

the panels having spaced upper and lower edges, each of the lower edges having thin, downwardly facing sharp edges comprising means for cutting into earth or sand to anchor the screen in the ground, each panel having a handle opening adjacent the center of one of the edges positioned for alignment with the handle openings in the other two panels when the panels are folded into said storage position; and a series of spaced, keyhole shaped cut-out flaps adjacent the lower edge of the panels.

* * * * *